United States Patent [19]

Spann

[11] 3,946,451

[45] Mar. 30, 1976

[54] LIMB SUPPORT

[76] Inventor: Donald C. Spann, 5 Ferncreek Court, Greenville, S.C. 29607

[22] Filed: Aug. 19, 1974

[21] Appl. No.: 498,400

[52] U.S. Cl. ..... 5/327 R; 5/92
[51] Int. Cl.[2] ..... A61G 7/02; A47C 22/00
[58] Field of Search ..... 5/92, 327 R, 338, 345

[56] References Cited

UNITED STATES PATENTS

| | | | |
|---|---|---|---|
| 3,345,656 | 10/1967 | Steinman | 5/327 R |
| 3,505,994 | 4/1970 | Smith, Jr. | 5/327 R |
| 3,511,233 | 5/1970 | Holy, Jr. | 5/327 R |

*Primary Examiner*—Casmir A. Nunberg
*Attorney, Agent, or Firm*—Bailey & Dority

[57] ABSTRACT

A limb support and the like is formed from a block of polyurethane foam having resilient characteristics, capable of permitting the passage of air and being of such configuration as to include a continuous open topped arcuate groove extending longitudinally along the length of the block for receiving, cradling and resiliently gripping the limb of a hospitalized patient to avoid rotation of the limb supported thereby.

1 Claim, 4 Drawing Figures

LIMB SUPPORT

BACKGROUND OF THE INVENTION

Heretofore, foam rubber padding has been used to support the limbs of hospitalized patients to prevent the formation of decubitus ulcers or bedsores on the heel which often result when the heel is allowed to contact the bed surface for prolonged periods of time. Such a limb supporting device is shown in United States letters Pat. No. 3,345,656. However, such a support does not maintain a resilient gripping engagement with the limb and is, therefore, ineffective to prevent rotation or turning of the limb when placed in the support.

Accordingly, an important object of the invention is to provide a support for gripping a lower limb in such a manner so as to prevent turning of the limb in the support providing therapy and comfort in the case of minor sprains, fractures, muscle pulls, etc. which do not otherwise require a cast.

Another important object of the invention is to provide a cast support that will maintain the heel above the bed surface to prevent heel ulcers and that will grip a limb and cast combination to prevent the limb from turning.

SUMMARY OF THE INVENTION

It has been found that a limb support can be constructed of a resilient, deformable polyurethane foam block having an open arcuate groove extending along the entire length of the block so that the limb is readily received when placed therein and the support will deform over its entire length, resiliently gripping the limb to prevent turning of the limb in the support. The support also maintains the heel of the limb above the bed surface to prevent heel ulcers and can further be used to secure a limb with a cast to prevent turning of the limb.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
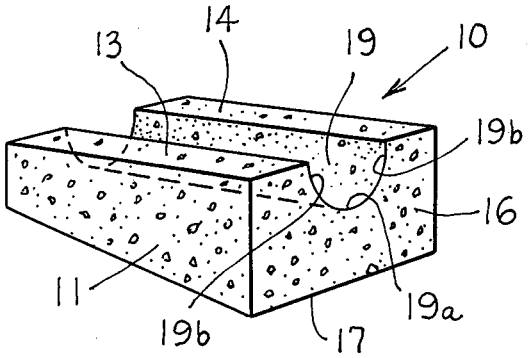
FIG. 1 is a perspective view illustrating a limb support constructed in accordance with the present invention.

The drawing illustrates a cast or a limb support and the like for supporting a limb of a patient and for gripping the limb in such a manner as to prevent turning of the limb.

An elongated support block, broadly designated at 10, is made of a resilient deformable polyurethane foam material which is lightweight and air-permeable.

Figure 4:
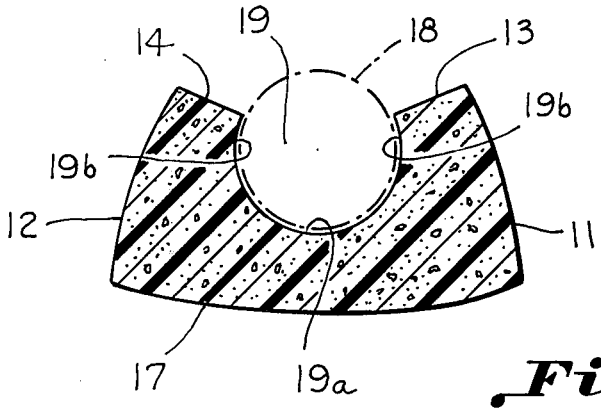
FIG. 4 is a sectional elevation taken on the line 4—4 of FIG. 2 showing the placement of a limb illustrating the grasping action thereof.

The block has the advantage of being inexpensive and suitable for one-patient use so that it does not have to be reused. The support block 10 may be used to support a freshly applied plaster cast without hindering the drying process of the plaster since air may readily circulate through the porous foam material. The elongated block 10 may be formed as by cutting or sawing a block to provide a pair of substantially vertical spaced side surfaces 11 and 12. Each of the sides 11 and 12 is joined respectively to top substantially horizontal planar surfaces 13 and 14 respectively. The planar surfaces 13 and 14 slope upwardly over the entire length of block 10 from a first end surface 15 to a second end surface 16. Interposed between the top planar surfaces 13 and 14 is an arcuate groove 19 extending over the entire length of the block 10 and inclined to a bottom base surface 17 for cradling a limb 18 of a bed patient. The arcuate groove 19 is most advantageously formed as substantially semicircular in cross-section for gripping the patient's limb 18 as the weight of the limb deforms block 10 as is best shown in FIG. 4. The flat bottom surface 17 provides a base surface for the support block 10 when placed on a bed.

Figure 2:
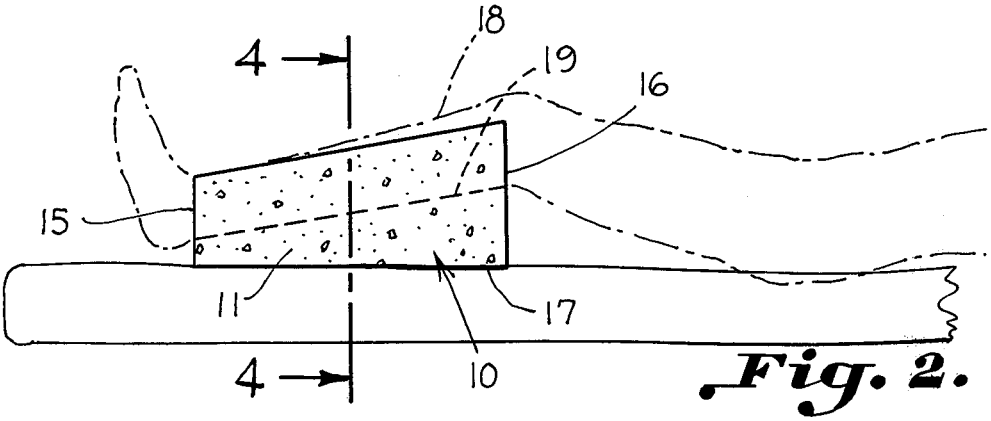
FIG. 2 is a side elevation of the limb support illustrating a reverse flex position.

In use, the limb support block 10 may be used to support the limb 18 of a bed patient in either one of two positions. First, as illustrated in FIG. 2, the limb support block 10 may be placed at the foot of the bed with the end surface 16 in a forward-most position facing toward the patient's head. In this position, the limb is supported in the block in a reverse flex position providing for a slight bending of the knee joint as the patient lies in a supine position. In the reverse flex position, more of the weight of the limb is supported at the end surface 16 which results in a greater deformation of the flock at that end than towards the end surface 15 causing the knee portion of limb 18 to be gripped tighter with a tapering off of the gripping action toward end surface 15. In the reverse flex position of FIG. 2, the knee portion is supported in the groove 19 at the highest elevation of the groove in the block 10. The remaining portion of the limb slopes downwardly following the contour of the groove to the lowest elevation thereof at the end surface 16. This positioning of the limb creates less pressure on the lower ankle portion providing increased blood circulation in the limb while supported and cradled in the groove.

Figure 3:
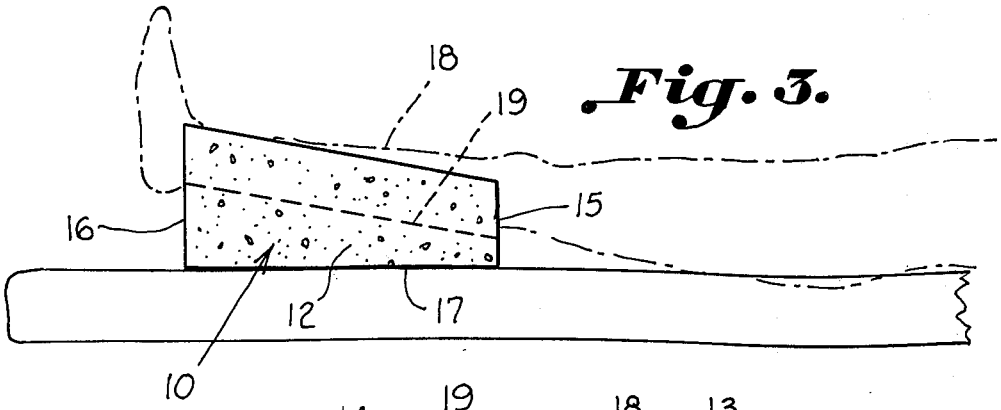
FIG. 3 is a side elevation of a limb support in accordance with the present invention with the limb support in a normal flex position.

In FIG. 3, the support block 10 is shown in a second position wherein the block 10 is placed at the foot of a bed with first end surface 15 in a forward-most position facing towards the head of the patient. In this position, the limb 18 is supported in groove 19 of block 10 in a normal flex position providing a substantially even distribution of the weight of the limb along the length of the groove. In the normal flex position, the knee portion of the limb is supported in the groove at the lowest elevation of the groove located in end surface 15 and the remaining portion of the limb slopes upwardly following the contour of the groove to the highest elevation of the groove located in end surface 16. Thus, the groove 19 of block 10 provides a cradle for the limb which uniformly grips the limb over the entire length of the groove to prevent turning of the limb in the support block 10.

The gripping action of the groove 19 is best illustrated in FIG. 4 which shows the deformation of the entire support block 10 upon placement of the limb in the groove. The weight of the limb exerted on the central lower portion 19*a* of the groove causes the entire inner surface of the groove to deform the grip the contour of the limb placed therein. The top edges 19*b* of the groove flexibly deform inwardly towards each other to grip around the top of the limb.

While the use of the support block 10 has been described as supporting the limb 18 of the bed patient, the block 10 may also be advantageously used to support the limb when placed in a cast. The support block 10 may be used to support the limb in a cast in both the reverse and normal flex positions in the same manner described above. In the event the plaster of the cast is wet when placed in groove 19 of block 10, the porous foam material of the block will enhance the drying of the cast. While the block 10 is primarily used to prevent turning of the limb, either with or without a cast, the support block 10 also provides the expedience of keeping the heel of the patient elevated above the bed surface to prevent the formation of heel ulcers or bedsores when the patient is confined to bed for prolonged periods of time.

While a preferred embodiment of the invention has been described using specific terms, such description is for illustrative purposes only, and it is to be understood that changes and variations may be made without departing from the spirit or scope of the following claims.

What is claimed is:

1. A support device for a patient's lower limb for use when the patient is confined to a bed to prevent turning of the limb comprising:

A. an elongated block of resilient deformable polyurethane foam material;

B. a flat bottom surface providing an elongated base for placement upon the bed surface:

C. a pair of spaced substantially vertical side surfaces;

D. a top planar surface inclined with respect to said bottom surface, and

E. an open continuous elongated arcuate groove of uniform cross section formed in said top planar surface along the entire length thereof defining first and second spaced inclined planar top portions extending the entire length of said block, said groove being inclined with respect to said bottom surface and being substantially semicircular in extent for providing a cradle for supporting and gripping a limb from a portion thereof adjacent the ankle to a portion thereof adjacent the knee;

whereby when a limb is placed in said central groove of the support, the support will deform over its entire length under the weight thereof exerted on a central lower portion of the groove causing depression of the resilient material therebeneath and inward flexing of upper portions of the groove tending to bring together said first and second top portions with resilient gripping of the limb within the entire length of said groove, thus avoiding turning of the limb while supporting the limb in an elevated position.

* * * * *